United States Patent [19]

Hancock et al.

[11] 3,949,344

[45] Apr. 6, 1976

[54] THERMOSTATIC CONTROL APPARATUS

[75] Inventors: John T. Hancock, Versailles, Ky.; James B. Allen, Richardson, Tex.; Glen C. Shepherd, Garland, Tex.; Joe W. Crawford, Dallas, Tex.

[73] Assignee: Texas Instruments Incorporated, Dallas, Tex.

[22] Filed: Dec. 9, 1974

[21] Appl. No.: 530,629

[52] U.S. Cl. ..... 337/347; 337/361

[51] Int. Cl.[2] ..... H01H 37/12

[58] Field of Search ..... 337/360, 361, 362, 368, 337/347, 380

[56] References Cited

UNITED STATES PATENTS

| | | | |
|---|---|---|---|
| 3,389,361 | 6/1968 | Manecke | 337/347 |
| 3,466,587 | 9/1969 | Rechou et al. | 337/347 |
| 3,803,526 | 4/1974 | Andersen | 337/347 X |
| 3,878,498 | 4/1975 | Allen et al. | 337/368 X |

*Primary Examiner*—G. Harris

*Attorney, Agent, or Firm*—James P. McAndrews; John A. Haug; Russell A. Baumann

[57] ABSTRACT

Thermostatic control apparatus comprising a switch, a switch body housing the switch, and an actuator arm extending from the switch body with the arm being movable between the first and second positions for opening and closing the switch. A thermostatic bimetal strip is spaced from the switch body, with one end of the strip being mechanically linked to the actuator arm. A support extends from the body for supporting the other end of the strip. A selectively operable adjustment cam engages the strip between its ends on the face of the strip adjacent the body, this cam being operable for adjusting the thermostatic strip to open and close the switch at various preselected temperatures. A spring biases the strip into engagement with the cam whereby changes in temperature of the strip cause the arm to move between its first and second positions thereby causing the switch to open and close.

16 Claims, 8 Drawing Figures

START 0°

START 0°
41°
360°

START 0°
175°
215°
360°

THERMOSTATIC CONTROL APPARATUS

BACKGROUND OF THE INVENTION

This invention relates to a thermostatic control, and more particularly to a bimetal thermostatic switch particularly adapted to control the operation of the compressor motor of a refrigerator or the like thereby by closely maintain the temperature within a refrigerator compartment within a predetermined range (e.g., 40°F ± 2°F).

In controlling the temperature within a refrigerator, it is important to insure that the temperature is accurately maintained within a relatively narrow range, such as specified above. If the temperature is allowed to drift appreciably above this range, spoilage of food may be hastened. If the temperature drifts below the 32°F, certain foods will, of course, freeze. In the past, so-called "change-of-state" temperature controls were widely used in refrigerators. These controls utilized a fluid expansion bulb (e.g., a capillary tube) having a fluid sealed therein which underwent a change in state (e.g., from a vapor to a liquid or vice versa) at a predetermined temperature (which depended on the pressure of the gas) and thus actuated a bellows-type actuator which in turn mechanically tripped an electric switch. These change-of-state controls are reliable and capable of being accurately calibrated to repeatedly switch the compressor motor on and off so as to maintain the temperature of the refrigerator within the predetermined range. However, these change-of-state switches are expensive and are relatively complicated.

Heretofore, bimetal thermostatic controls have widely been used as room air conditioner controls. Reference may be made to such U.S. Pat. Nos. as 2,074,132, 3,293,875, Re. 26,554, and the co-assigned U.S. Pat. No. 3,546,652 for examples of such room air conditioner controls. Generally, these controls include a bimetal thermostatic strip adjustably mounted so as to open or close the electrical contacts of a switch to make and break a circuit supplying electrical power to the air conditioner's compressor motor. In the above mentioned U.S. Pat. Nos. 3,293,875 and 3,546,652 provision is made for adjusting the bimetal strip to open and close the switch contacts within the switch at any desired temperature within a limited operating range.

However, it has been found that these room air condition bimetal controls are not wholly suitable as cold controls for refrigerators. Refrigerators has been developed to the point where they have a reliable operating life of 10 to 15 years, and temperature controls must be capable of reliably switching the compressor motor on and off many times a day under severe humidity and other environmental conditions within the refrigerator for the life of the refrigerator (e.g., 750,000 cycles may be required). Since bimetal thermostatic switches utilize the thermal flexure of a bimetal element to sense temperature changes, the narrow temperature ranges in which the temperature of the refrigerator must be maintained require that the switch must be sensitive to small movements of the bimetal element. The bimetal cold controls, of necessity, must be made of insulative material so as to electrically insulate parts of the switch. Over long periods of time and exposure to high humidity, these insulative materials may undergo slight dimensional changes which significantly alter the amount of movement of the bimetal required to actuate the switch. Thus, over a long period of time (e.g., several years), the temperatures at which the compressor motor is energized and de-energized may change or drift appreciably. The temperature drift of a control should be less than plus or minus 2°F. over the life of the refrigerator. Prior bimetal controls experienced significantly more drift than this.

Also prior bimetal controls were sometimes exposed to relatively high or low ambient temperatures during shipping which, under some circumstances, caused the bimetal element to be overstressed and thus to yield causing it to lose its calibration. More specifically, bimetal switches are conventionally shipped in their locked off position in which the bimetal element is mechanically stressed to exert a maximum force on the switch thereby to maintain the switch open during shipping. While in transit, this switch may experience ambient temperatures between + 150°F. and − 50°F. These temperature extremes may superimpose a thermal stress on the bimetal element which is additive to the mechanical stress previously applied thereto and thus may cause the bimetal element to permanently yield.

SUMMARY OF THE INVENTION

Among the several objects of this invention may be noted the provision of a bimetal thermostatic control switch which is particularly adapted to accurately and reliably control the temperature in a refrigerator within a relatively narrow range; the provision of such a switch which has a life expectancy equivalent to the life expectancy of a refrigerator; the provision of such a switch which accurately and reliably switches the refrigerator compressor motor on and off many times a day; the provision of such a switch which is substantially linearly adjustable throughout a predetermined range of temperatures; the provisin of such a switch in which the effects of dimensional changes are minimized; a provision of such a switch which is not susceptible to damage due to large variations in ambient temperatures to which it may be subjected such as during shipping; the provision of such a switch which is not affected by mechanical forces or stresses as may be imposed on the switch by physically mounting the switch in a refrigerator; the provision of such a switch which is of compact size, and which is readily assembled; the provision of such a switch which accurately senses the temperature in the refrigerator compartment; and the provision of such a switch which is economical to manufacture, easy to install and to service (if required), and reliable in operation.

Briefly, a thermostatic control of this invention comprises a switch, a switch body housing the switch, and an actuating arm extending from the switch body, this arm being movable relative to the switch body between a first and a second position for opening and closing the switch. A thermostatic bimetal strip is spaced from the body, one end of the strip being mechanically linked to the actuating arm. A support extends from the housing and supports the other end of the strip. Selectively operable adjustment means is engageable with the strip between its ends on the face of the strip adjacent the body. This adjustment means is operable for adjusting the strip to open and close at various preselected temperatures. Spring means bias the strip into engagement with the adjustment means whereby changes in temperature of the strip cause the arm to move between its first and second positions thereby causing the switch to open and close.

Other objects and features of this invention will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
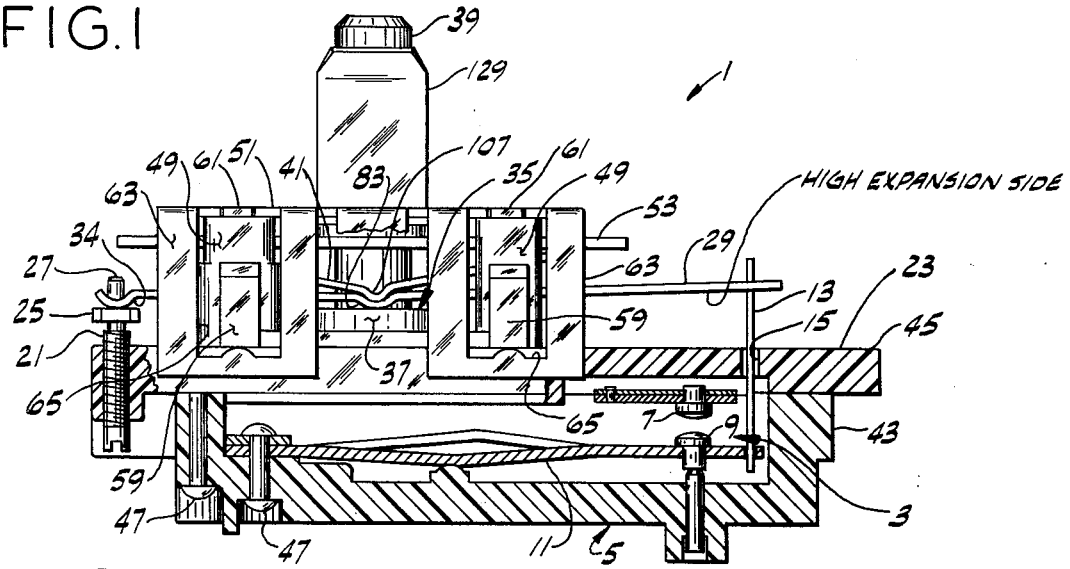
FIG. 1 is a side elevational view of a thermostatic control switch of this invention with some parts shown in cross section to illustrate details of the switch.
Figure 2:
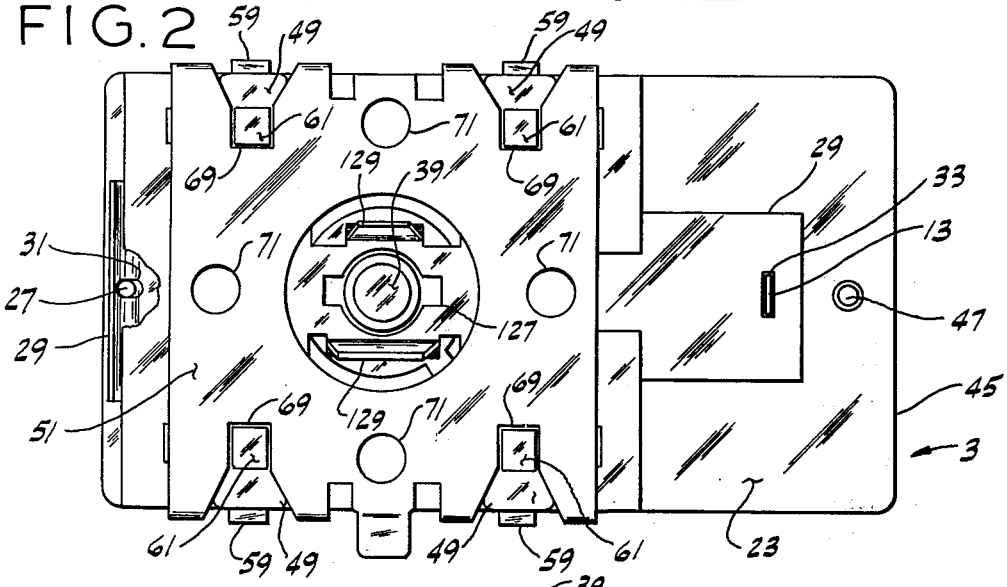
FIG. 2 is a plan view of the switch of FIG. 1.
Figure 3:
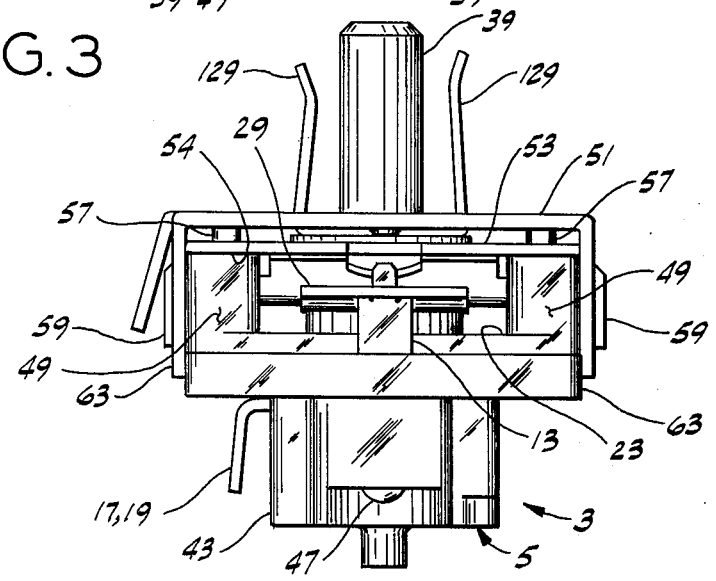
FIG. 3 is a right end view of the switch of FIG. 1.

Referring now to the drawings, a thermostatic control switch of this invention is indicated in its entirety at 1 and is shown to comprise a switch 3 housed in a housing or switch body 5 of electrically insulative synthetic resin material, such as a molded phenolic plastic or the like. This switch is a snap acting switch similar to the switch described in the coassigned U.S. Pat. No. 3,546,652. This switch has a stationary contact 7 and a movable contact 9 carried by a snap spring contact blade 11 abruptly moveable between an open position (shown in FIG. 1) in which the contacts are spaced from one another and a closed position (not shown) in which the contacts are in engagement with one another so as to make and break an electrical circuit. The spring blade is biased to close the contacts. A rigid compression link or actuating arm 13 of insulative material is carried by the outer end of the movable spring blade and it extends through an opening 15 in housing 5 for movement relative to the housing between a first position in which the contacts are closed and a second position in which the contacts are open for opening and closing the switch. More particularly, upon applying a sufficient compression force to the actuating arm, the spring blade may be moved against its bias to abruptly move with a snap from its first to its second position to open the contacts. Upon relieving the load from actuating link 13, the bias of spring blade 11 causes it to again move with a snap to abruptly close the contacts. Electrical terminals 17 and 19 are provided for contacts 7 and 9, respectively, for connection to a load, for example, to the compressor motor of a refrigerator or the like.

An adjustable support screw 21 is threaded in one face 23 of housing 5. For convenience, this one face of housing 5 will be referred to as its top face but it will be understood that the orientation of the housing is not important to the operation of the switch. Support screw 21 has an integral support shoulder 25 and a locating pin 27 extending endwise therefrom for purposes as will appear.

A thermostatic bimetal strip 29 is spaced from the top of housing 5 above surface 23 and it is substantially parallel thereto. This strip has a hole 31 at one end for reception of locating pin 27 of adjustment screw 21 and a transverse slot 33 at its other end for reception of the upper end of actuating arm or link 13 whereby the strip is simply supported at its ends on its longitudinal centerline by the upper face of shoulder 25 of support screw 21 and by actuating arm 13 and is mechanically linked to the actuating arm. The above mentioned one end of strip 29 is bent transversely of the strip to form a downwardly facing round rib 34 serving as a rockable support for bearing against the upper face of shoulder 25. Hole 31 is centered in this downward projection and is of somewhat larger cross section than locating pin 27 thereby to insure that this one end of the beam is unrestrained during flexing and adjustment of the thermostatic strip. The bimetal strip is arranged with its high expansion face facing toward housing 5 so that upon cooling below a first predetermined temperature (e.g., 38°F.), the bimetal strip will deflect a sufficient amount to overcome the bias of spring blade 11 and to thus abruptly move the actuating arm and the spring blade from its first to its second positions so as to open contacts 7 and 9. Conversely, upon being heated above a second predetermined temperature level (e.g., 42°F.), the bimetal strip will flex in the opposite direction a sufficient distance to permit the bias of the spring blade to overcome the force exerted on the actuating arm 13 by the bimetal strip to thus permit the contacts to snap closed thereby energizing the electrical circuit (e.g., the compressor motor of the refrigerator). The temperature range between these two temperatures may be referred to as the switch differential.

In accordance with this invention, selectively operable adjustment means, as indicated at 35, comprises an adjustable abutment in the form of a rotary face cam 37 manually adjustable by a rotary shaft 39. This cam is interposed between bimetal strip 29 and housing 5 and is engageable with the bimetal strip intermediate its ends on its one face toward the housing 5 (i.e., the cam cam engages the bottom face of the bimetal strip) for adjustably moving the portion of the strip adjacent the cam toward and away from the housing thereby to selectively adjust the thermostatic strip to open and close contacts 7 to 9 of switch 3 at various preselected temperatures. A generally V-shaped flat compression spring 41 is engageable with the other or upper face of the bimetal strip and biases the latter toward engagement with cam 37.

More particularly, housing 5 comprises a rectangular cup-shaped switch case 43 enclosing contacts 7 and 9 and spring blade 13, and a relatively thick cover 45 of molded phenolic resin extending beyond the sides of the case and being approximately the same length as the case. The case is secured to the cover by rivets 47. Four mounting posts 49 extend upwardly from the top face 23 of the cover above the level of bimetal strip 29, two of these posts being on one side of the strip and two on the other side. A switch mounting plate 51 is adapted to be secured (i.e., snapped) to posts 49 in a manner as will appear. A guard plate 53 is interposed between spring 41 and the bottom face of mounting plate 51. Posts 49 have shoulders 54 on their inside faces spaced somewhat below their tops. Guard 53 is notched, as indicated at 55, for reception of posts 49 thereby to positively locate the guard with respect to the posts and to bear on shoulders 54. The guard further has upwardly extending tabs 57 adjacent notches 55. These tabs space the guard from the lower or bottom face of mounting plate 51. Spring 41 bears against the undersurface of the guard and thus constitutes an abutment for spring 41. Posts 49 each have locking lugs 59 on their outer vertical faces and locating lugs 61 on their upper ends. Mounting plate 51 has a resilient locking bracket 63 for each post 49. These locking brackets extend downwardly substantially perpendicular to the mounting plate, each bracket 63 has an opening 65 with an edge 67 engageable with the under edge of a respective locking lug 59 on a respective post, and a notch 69 in the upper face of the mounting plate for receiving locating lug 61. Thus, notches 69 engage the locating lugs so as to substantially prevent horizontal movement of mounting plate 51 with respect to the post and the edges 67 are resiliently engageable with locking lugs 59 so as to securely hold the mounting plate vertically on post 49. Upon assembling the control of this invention, the thermostatic strip 29, spring 41, and guard 53 are placed in their assembled relation (as shown in FIG. 1) and mounting plate 51 is snapped into position on lugs 49 so that locking brackets 63 resiliently engage their respective locking lugs 59 so as to hold the above mentioned parts in assembled relation without the use of screws or other fasteners. Thus, mounting plate 51 constitutes securement means for holding the bimetal strip and spring in their assembled relation together with can 37 and shaft 39.

Four tapped holes 71 are provided in the upper face of mounting plate 51 for threadably receiving mounting screws (not shown) and for securing the mounting plate and the switch on a member, such as on the inner face of the liner of a refrigerator. It will be understood that by securing the mounting plate to the switch in this manner any mounting loads, such as twisting of the mounting plate by increased screw torque, are substantially prevented from being transmitted to housing 5. Thus, calibration of bimetal strip 29 and the switch are not adversely affected by mounting loads.

Figure 4:
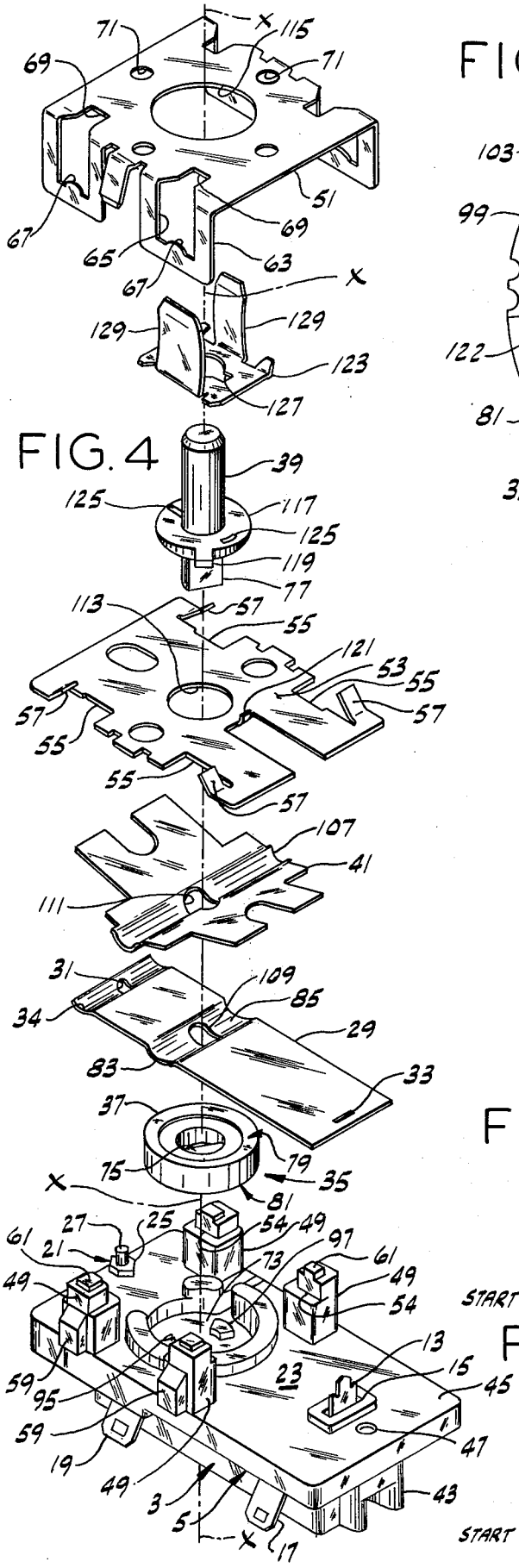
FIG. 4 is an exploded view of the various parts of the switch of this invention.
Figure 5:
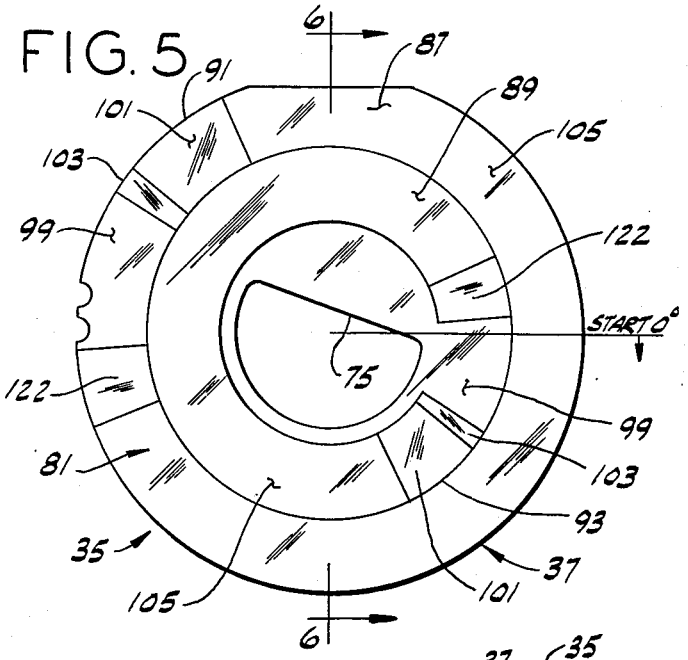
FIG. 5 is a view of a cam for adjusting the thermostatic strip of the control of this invention.
Figure 6:
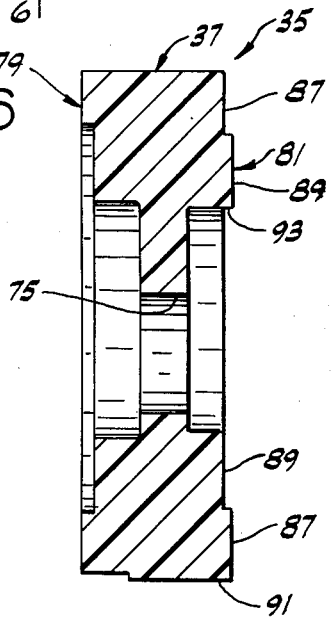
FIG. 6 is a vertical section taken on line 6—6 of FIG. 5.

As heretofore pointed out, adjustment means 35 for bimetal strip 29 is a rotary face cam 37. As best shown in FIG. 4, this cam is socketed in a socket 73 formed in the upper face of cover 45 and is rotary about a cam axis X—X generally coaxial with shaft 39 and perpendicular to the longitudinal center line of strip 29. Cam 37 has a semi-circular opening 75 at its center for reception of a semi-circular lug 77 extending down from shaft 39 for positively rotating the cam with the shaft about the cam axis. Cam 37 is free to move axially on lug 77 along the cam axis in and out of socket 73, in a manner as will appear, between a lowered retracted or inoperative position (see FIG. 1) in which the cam is at least partially retracted into the socket a maximum distance and an extended or operative position (not shown) in which the cam moves outwardly into camming engagement with strip 29 and causes at least a portion of the strip to move toward and away from housing or switch body 5 so as to vary the temperature at which the strip effects opening and closing of the switch 3. More particularly, cam 37 has a first cam face 79 facing away from switch body 3 (i.e., it faces toward the bimetal strip) and a second cam face 81 facing toward the switch body. The first cam face 79 is essentially fat (i.e., it is perpendicular to the cam axis) and is adapted to concurrently and uniformly engage the bimetal strip on opposite sides of the longitudinal centerline of the strip intermediate its ends for selectively adjusting the deflection of the strip by spring 41 and thus for adjusting the temperature at which the bimetal strip will effect opening and closing of switch 3.

More particulary, a bimetal strip 29 has cam follower means constituting a projection or rib 83 formed thereon extending transversely of the strip. Rib 83 is convex on its lower face and forms a transverse concave groove 85 on the upper face of the strip for purposes as will appear. As best seen in FIG. 1, cam faces 79 engages the convex face of rib 83 on opposite sides of the longitudinal center line of strip 29 thereby to apply uniform camming action to the bimetal strip and to prevent rotation thereof about its longitudinal center line. Thus, the bimetal strip remains stable on camming of the cam.

Figure 8:
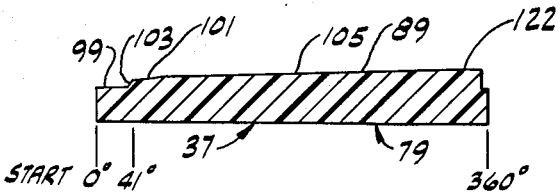
FIG. 8 is a developed view of a second cam surface of the cam shown in FIG. 5 on a reduced scale.
Figure 7:
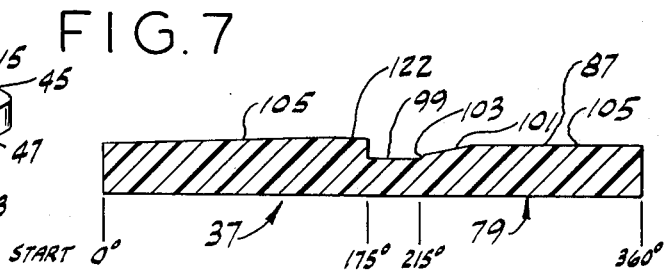
FIG. 7 is a developed view illustrating a first cam surface of the cam shown in FIG. 5 on a reduced scale.

Cam face 81 has two circular cam surfaces 87 and 89 thereon concentric about the cam axis with cam surface 87 being the outer cam surface and substantially surrounding the inner cam suface 89. Cam surfaces 87 and 89 each have cam formations, generally indicated at 91 and 93, respectively, thereon cammingly engageable with respective stationary cam followers 95, 97 formed in cover 45 at the base of socket 73. As best shown in FIGS. 7 and 8, these cam surfaces 87 and 89 each have a dwell or recess portion (also referred to as a first portion) 99, a relatively steep cam rise portion (also referred to as a second portion) 101, a transition slope 103 between the dwell and rise portions, and a relatively flat cam portion (also referred to as a third cam portion) 105. It will be noted that the cam formations 91 and 93 of cam surfaces 87 and 89, respectively, are diametrically opposed to one another on opposite sides of the cam axis so that the corresponding cam formations (e.g., rise portions 101) of both cam formations simultaneously engage their respective cam followers 95 and 97 thereby to effect axial movement of cam 37 along its cam axis (i.e., to effect movement of the cam along lug 77 of shaft 39 from its inoperative retracted position when its first or dwell cam portions 99 are in register with the cam followers to its operative extended position when its second or steep rise cam portion 101 is in register with the cam formations for moving a portion of the strip away from switch body 5). It will be noted that by providing dual engagement of dual cam formations 87 and 89 on opposite sides of the cam axis the cam is caused to move axially along the cam axis without tilting or cocking. This insures that cam face 79 uniformly engages cam follower projection 83 on opposite sides of the center line of strip 29 thereby to uniformly deflect the strip about a transverse axis as it is supported at its ends without causing it to rotate or twist on its longitudinal center line. These features help to minimize nonlinearity adjustment and environmental drift problems. By locating the cam under the bimetal strip (i.e., by mounting the cam on the side toward housing 5) the amount of synthetic resin material between the bimetal strip and switch 3 is lessened and thus there is less material to be affected by environmental changes (e.g., by dimensional instabilities caused by high relative humidity).

With cam 37 in a first rotary position (as shown in FIG. 1) in which the cam is in its retracted or inoperative position, dwell portions 99 are in register with their respective cam followers 95 and 97 so that the cam is in its retracted inoperative position within socket 73. With the cam in its first rotary position, spring 41 deflects strip 29 a maximum amount and thus applies a maximum downward compression force on actuating arm 13 so as to insure that the bias of snap spring 11 is overcome and to thus insure that contacts 7 and 9 are open. This first rotary position may be referred to as the full-off or the lock-off position. Upon rotation of the cam from its first rotary position to a second rotary position, the relatively steep transition portions 103 and cam rise portions 101 engage their respective cam followers. As the rise portions engage their cam followers, the cam rapidly moves axially along the cam axis because of the relatively steep cam slopes. This rapid movement of the cam corresponds generally to the axial movement of a coarse pitch screw thread. Typically, to rotate the cam through its rise portions and onto surfaces 105 about 41° of rotation of shaft 39 is required. Upon rotation of the cam to its operative position in which cam followers 95 and 97 engage the relatively flat cam surfaces 105, the load on link 13 is lessened almost to the point where contacts 7 and 9 may be snapped closed. Preferably, this will occur near the midpoint of cam portions 105 and thus corresponds to a typical midrange temperature set point for the switch. It will be noted that because of the relatively shallow slope of the cam portions 105, a considerable rotation of shaft 39 involves only a minor axial movement of the cam so that a desired temperature set point may be conveniently and accurately selected. This relatively shallow slope of cam portions 105 therefore functions in a manner similar to a fine pitch adjustment screw. Thus, the combination steep and shallow cam portions 101 and 105 constitute a dual pitch adjustment for selectively adjusting the force applied to bimetal strip 29.

As best shown in FIG. 4, spring 41 is a flat compression spring generally V-shaped in longitudinal cross section having a downwardly facing transverse projection or rib 107 at its center, generally arcuate in cross section and extending downwardly to nest within complementarily shaped groove 85 of bimetal strip 29 to thus provide a rockable contact line for the spring on the bimetal strip. The outer ends of the spring engage the under surface of guard plate 53. With the cam in its retracted position, spring 41 causes the strp to flex toward surface 23 of housing 5 and to thus open the switch. As previously mentioned, this permits the application of maximum downward force on link 13 and insures that contacts 7 and 9 are open. It will be understood that with the cam 37 in its fully retracted or full-off position, the cam may be clear of projection 83 on the bottom face of the bimetal strip so that the cam does not suport any of the load applied to the strip by the spring. Thus, with the cam retracted, the force of the spring on the strip is opposed by an equal and opposite spring force of the deflected strip on the spring. As the cam is rotated from its retracted position to another rotary position in which transition portions 105 engage cam followers 95 and 97, the cam does not apply an appreciable load to the strip. Thus, even though rotated through its relatively steep rise cam portions 101, a relatively low amount of torque is required to be applied to shaft 39 to effect rotation of the cam. As cam face 79 moves into engagement with projection 83 on strip 29 and as shallow cam portions 105 move into engagement with their respective cam followers 95 and 97, the strip deflected by the spring is unloaded and the spring is further compressed. Thus, cam 37 is placed under a gradually increasing load. As a consequence, there is no abrupt change in torque required to be applied to shaft 39 so as to rotate cam 37 through its various rotary positions. Thus, it may be said that the thermostatic switch of this invention is a constant torque switch.

It will also be understood that with the bimetal strip 29 simply supported by link 13 and by support screw 21, with the floating cam 37, and with the floating compression spring 41 biasing the strip toward engagement with the cam, the effect of mounting loads, and environmental, dimensional, physical property changes of the various parts of the switch are minimized. It will also be understood that the snap assembly of mounting plate 51 on posts 49 and the compression of spring 41 isolates any movement of the mounting plate and spring from the bimetal strip upon the assembly or installation of the switch and thus insures that the bimetal strip will retain within acceptable tolerances temperature calibration as initially set by adjustment of screw 21.

Strip 29, spring 41, guard 53 and mounting plate 51 each have an opening 109, 111, 113 and 115, respectively, therein in axial alignment with one another for reception of shaft 39 extending from cam 37 and extending exteriorly of the mounting plate. Shaft 39 has an enlarged flange 117 intermediate its ends adapted to bear against the upper face of guard 53 adjacent the opening therein. Flange 117 has an outwardly extending lug 119 engageable with a stop 121 struck upwardly from guard 53 so as to prevent rotation of the shaft beyond a predetermined rotary position corresponding to cam formations 122 on cam surfaces 87 and 89 being in engagement with cam follower formations 95 and 97. A U-shaped knob securement clip 123 is interposed between the upper face of flange 117 and the lower face of mounting plate 51. Interlock lugs 125 on the upper face of the flange are received by grooves 127 on the base of the clip and thus cause the clip to rotate with the flange and the shaft. The clip has legs 129 which extend outwardly through the enlarged opening 115 and the mounting plate so that a knob (not shown) may be snapped thereon. As previously mentioned, the mounting holes 71 permit the switch to be readily mounted within a refrigerator or the like.

In accordance with this invention, switch 1 is not adversely affected (i.e., damaged) by extreme changes in ambient temperature that may possibly be encountered in shipping. For example, ambient temperatures as high as +150°F. and as low as −50°F. may possibly be encountered. In conventional bimetal control switches, the bimetal is flexed by an adjustment cam or screw engageable with the strip intermediate its ends so that the bimetal strip applies a maximum force on the switch to insure the switch contacts are opened. Typically, these switches are shipped in their "locked-off" position with the bimetal solidly restrained by its supports and by the adjustment cam and is thus mechanically stressed to a relatively high level. Upon these switches being exposed to an extreme ambient temperature, the thermal stresses generated in the bimetal may be superimposed on the mechanical stress previously in the strip, thus exceeding the elastic limit of the strip and causing it to yield and thus deleteriously affecting the calibration of the control.

In the present invention, only spring 41 applies load to strip 29 when the switch is in its "locked-off" position. More particularly, cam 37 applies little or no load to the strip. Upon the switch of this invention being exposed to an extreme ambient temperature level, the strip is not rigidly constrained but rather may flex, compressing the spring. Because the strip may flex, the thermal stress induced in the strip is significantly reduced. For example, if the thermostatic control switch 1 of the invention is exposed to a high ambient temperature (e.g., +150°F.), the end of strip 29 supported by actuating arm 13 will flex away from the actuating arm (due to differential thermal stresses in the strip and due to the orientation of the high expansion side of the strip toward switch housing 5), and thus is not solidly restrained. If the switch is exposed to an extremely low ambient temperature, the strip tends to flex in the opposite direction and the center of the strip moves away from the cam 37 and resiliently compresses spring 41. Thus, either the bimetal strip 29 of the control of this invention is not adversely affected by normally encountered ambient temperature extremes (i.e., the strip does not yield) or it can withstand substantially greater ambient temperature extremes.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A thermostatic control apparatus comprising:

a switch;

a switch body housing said switch;

an actuator arm extending from said switch body, said arm being movable relative to said switch body between first and second positions for opening and closing said switch;

a support extending from said switch body;

a thermostatic strip of bimetal material spaced from said said switch body, one end of said strip being supported by said support and the other end of said strip being mechanically linked to said arm;

selectively operable adjustment means engageable with said strip between its ends on one face thereof adjacent said switch body, said adjustment means being operable for adjusting said strip to open and close said switch at various preselected temperatures; and spring means for biasing said strip into engagement with said adjustment means whereby changes in temperature of said strip cause said arm to move between its first and second positions thereby to open and close said switch, and whereby under extreme ambient temperature conditions said thermostatic strip is not unduly stressed but may flex against the bias of said spring means.

2. A thermostatic control apparatus as set forth in claim 1 wherein said adjustment means comprises rotary cam means engageable with said one face of said strip.

3. A thermostatic control apparatus as set forth in claim 2 wherein said strip is supported at its ends substantially on its longitudinal center line, and wherein said strip has cam follower means on said one face on opposite sides of its longitudinal center line engaged concurrently and uniformly by said cam means thereby substantially to resist rotation of the strip about its longitudinal center line upon rotation of said cam means.

4. A thermostatic control apparatus as set forth in claim 3 wherein said cam follower means comprises a projection struck from said strip extending toward said cam means for engagement thereby, aid projection extending transversely of said strip on opposite sides of said center line.

5. A thermostatic control apparatus as set forth in claim 3 wherein said cam means comprises a rotary face cam socketed in said housing for rotation about a cam axis generally perpendicular to said longitudinal centerline of the strip, said cam having a first cam face facing away from said switch body and a second cam face facing toward said switch body, said first cam face being engageable with said cam follower means on said strip, said second cam face having cam formations thereon, said housing having stationary follower means engageable by said cam formations on said second cam face, said cam being axially movable along said cam axis toward and away from said strip between an inoperative position in which said cam is at least partially retracted within said socket and an operative position in which the cam extends at least partially out from said socket and cammingly engages said strip thereby to effect movement of at least a portion of said strip adjacent said cam toward and away from said switch body so as to vary the temperatures at which said strip effects opening and closing of said switch.

6. A thermostatic control apparatus as set forth in claim 5 wherein said second cam face cam formations include a first cam surface and a second cam surface, and wherein said stationary cam follower means in said switch body includes a first cam follower engageable by said first cam surface of said second cam face and a second cam follower engageable by said second cam surface of said second cam face, each of said cam surfaces having a first portion which when in register with its respective stationary cam follower permits said cam to be in its said retracted inoperative position, and one or more cam rise portions which when in engagement with their respective stationary cam follower effect axial movement of said cam along said cam axis away from said switch body toward its operative position and toward engagement with said strip for moving the latter away from said switch body.

7. A thermostatic control apparatus as set forth in claim 6 wherein said cam surfaces are generally circular with said second cam surface being on the outside of said first cam surface, said first and second stationary cam followers being spaced from one another on opposite sides of said cam axis, and said rise portions of said first and second cam surfaces being diametrically opposed to one another so that they engage their respective stationary cam followers substantially simultaneously and thus effect movement of said cam toward and away from said strip in a direction substantially along said cam axis whereby said first cam face uniformly engages said strip on opposite sides of said longitudinal centerline.

8. A thermostatic control apparatus as set forth in claim 1 wherein said switch body has mounting means secured thereto, said mounting means being spaced from and extending across the switch body with said strip positioned between said switch body and said mounting means, said spring being interposed between said mounting means and said strip.

9. A thermostatic control apparatus as set forth in claim 4 wherein said projection on said strip constitutes a rib of generally arcuate cross section extending toward said cam, sid rib forming a groove in the opposite face of said strip, and wherein said spring has a transverse projection intermediate its ends extending therefrom toward said strip, said projection in said spring being of generally arcuate cross section and being nestable in said groove, whereby said spring rockably engages said strip.

10. A thermostatic control apparatus as set forth in claim 8 wherein said strip, said spring and said mounting means each have an aperture therethrough, said apertures being in register with one another, and wherein said apparatus further comprises a shaft, said cam being carried by the shaft for rotation therewith and said shaft extending through said apertures exteriorly of said apparatus for adjustably rotating said cam.

11. A thermostatic switch as set forth in claim 1 wherein said one face of said bimetal thermostatic strip is its high expansion face.

12. A thermostatic control as set forth in claim 1 wherein said adjustment means comprises an abutment engageable with said one face of said strip, said abutment being adjustably moveable toward and away from said strp between an inoperative position in which said spring means deflects said strip a maximum amount and an operative position in which said abutment engages said strip thereby to effect movement of a portion of said strip toward and away from said switch body against the bias of said spring means so as to vary the temperatures at which said strip effects opening and closing of said switch.

13. A thermostatic control as set forth in claim 12 wherein said thermostatic strip has both a low and a high coefficient of thermal expansion side with said high expansion side constituting said one face, and wherein with said abutment in its inoperative position and with said strip exposed to a relatively low ambient temperature level, the deflection of said strip due to its differential thermal expansion resiliently reacts against said spring and thus prevents permanent deformation of said strip.

14. A thermostatic control apparatus comprising a switch, a housing for the switch, an actuator for the switch extending from the housing, a thermostatic strip supported by the housing and linked to the actuator for actuating the switch at various temperatures, adjustable means between said housing and one face of said strip engageable with said strip intermediate the ends of the strip for adjusting the strip to actuate the switch at various desired temperatures, a spring engageable with the strip to resiliently bias the strip toward said adjustment means, and securement means for holding said strip and said spring in assembled relation to one another, said housing having portions thereof engageable by said securement means and said securement means having portions resiliently engageable with said housing portions for enabling said securement means and said housing to be snapped together and for securing said strip and said spring in their said assembled relation.

15. A thermostatic control apparatus as set forth in claim 14 wherein said securement means further comprises means for also securing said adjustable means in position on said apparatus, whereby upon snapping together said securement means and said housing, said adjustable means, said strip and said spring are simultaneously held in position on said housing.

16. A thermostatic switch comprising a support, switch means having an actuator, thermostatic means for actuating the switch via the actuator, said thermostatic means comprising a thermostatic strip supported at one end thereof on said support with one face of the strip engaging the support and having its other end engaged with the actuator, and means between the ends of the strip for adjusting the strip to open and close the switch means at different desired temperatures, said strip being a bimetal strip having a high expansion side, said high expansion side constituting said one face of the strip, characterized in that said adjustment means comprises an abutment for the strip intermediate its ends and engageable by the strip on said one face of the strip, and spring means biasing said strip toward engagement with said abutment, said abutment being adjustably movable from an inoperative position in which said strip is deflected a maximum amount by said spring and an operative position in which said abutment adjustably deflects a portion of the strip for adjusting the strip to open and close said switch means at various preselected temperatures, wherein with said abutment in its inoperative position and with said strip cooled below a desired temperature, said strip may flex away from said abutment against the bias of said spring means.

* * * * *